US010453439B2

(12) United States Patent
Pfaffinger

(10) Patent No.: US 10,453,439 B2
(45) Date of Patent: Oct. 22, 2019

(54) NOISE AND VIBRATION SENSING

(71) Applicant: Harman Becker Automotive Systems GmbH, Karlsbad (DE)

(72) Inventor: Gerhard Pfaffinger, Regensburg (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 9 days.

(21) Appl. No.: 15/770,266

(22) PCT Filed: Oct. 10, 2016

(86) PCT No.: PCT/IB2016/056044
§ 371 (c)(1),
(2) Date: Apr. 23, 2018

(87) PCT Pub. No.: WO2017/068455
PCT Pub. Date: Apr. 27, 2017

(65) Prior Publication Data

US 2018/0301137 A1 Oct. 18, 2018

(30) Foreign Application Priority Data

Oct. 22, 2015 (EP) ..... 15190987

(51) Int. Cl.
*G10K 11/16* (2006.01)
*G10K 11/178* (2006.01)
*H04R 5/02* (2006.01)

(52) U.S. Cl.
CPC .. *G10K 11/17835* (2018.01); *G10K 11/17833* (2018.01); *G10K 11/17853* (2018.01);
(Continued)

(58) Field of Classification Search
CPC ..... G10K 11/17835; G10K 11/17853; G10K 11/17833; G10K 2210/1282; G10K 2210/3028
(Continued)

(56) References Cited

U.S. PATENT DOCUMENTS 5,939,625 A 8/1999 Torii et al.
2004/0240677 A1 12/2004 Onishi et al.
(Continued)

FOREIGN PATENT DOCUMENTS

EP 1489594 A2 12/2004
JP 2007331490 A 12/2007
(Continued)

*Primary Examiner* — Xu Mei
*Assistant Examiner* — Ammar T Hamid
(74) *Attorney, Agent, or Firm* — Brooks Kushman P.C.

(57) ABSTRACT

An active road-noise control system and method include using a sensor arrangement to generate a first sense signal representative of at least one acceleration, motion and/or vibration that occurs at a first position on a vehicle body and a second sense signal representative of sound that occurs at a second position within the vehicle body; they also provide a noise-reducing signal by processing the sense signals according to a first or a second mode of operation. They include the generation of noise-reducing sound within the vehicle body at the second position from the noise reducing signal and the operational state of the sensor arrangement; the first sense signal and the second sense signal are processed in the first mode when the sensor arrangement is in a proper operational state and in the second mode when a malfunction of the sensor arrangement has been detected.

18 Claims, 7 Drawing Sheets

(52) U.S. Cl.
CPC ..... *G10K 2210/1282* (2013.01); *G10K 2210/12821* (2013.01); *G10K 2210/3028* (2013.01); *G10K 2210/3226* (2013.01); *G10K 2210/501* (2013.01); *G10K 2210/503* (2013.01)

(58) Field of Classification Search
USPC ..... 381/71.4, 302
See application file for complete search history.

(56) References Cited

U.S. PATENT DOCUMENTS

| | | | | |
|---|---|---|---|---|
| 2006/0181066 | A1 | 8/2006 | Andres et al. | |
| 2010/0124337 | A1* | 5/2010 | Wertz ..... | G10K 11/178 381/71.11 |
| 2014/0072134 | A1 | 3/2014 | Po et al. | |

FOREIGN PATENT DOCUMENTS

| | | | |
|---|---|---|---|
| WO | 9603945 | A1 | 2/1996 |
| WO | 2013076137 | A1 | 5/2013 |

* cited by examiner

NOISE AND VIBRATION SENSING

CROSS-REFERENCE TO RELATED APPLICATION

This application is the U.S. national phase of PCT Application No. PCT/IB2016/056044 filed on Oct. 10, 2016, which claims priority to EP Patent Application No. 15190987.6 filed on Oct. 22, 2015, the disclosures of which are incorporated in their entirety by reference herein.

FIELD

The disclosure relates to noise and vibration sensor arrangements for road-noise control systems, active road-noise control systems and noise and vibration measurement methods.

BACKGROUND

When driven on roads and other surfaces, land-based vehicles generate low-frequency noise known as road noise. Even in modem vehicles, cabin occupants may be exposed to road noise transmitted to the cabin through the structure (e.g., via tire-suspension-body-cabin paths) or through airborne paths (e.g., tire-body-cabin paths). Reducing the road noise experienced by cabin occupants is desirable. Active noise, vibration and harshness (NVH) control technologies, including active road-noise control (RNC) systems, can be used to reduce these noise components without modifying the vehicle's structure, as active vibration technologies do. However, active sound technologies for road-noise cancellation may require very specific noise and vibration (N&V) sensor arrangements throughout the vehicle structure in order to observe road noise and vibration signals.

SUMMARY

An exemplary active road-noise control system includes a sensor arrangement configured to generate a first sense signal representative of at least one acceleration, motion and/or vibration that occurs at a first position on a vehicle body and a second sense signal representative of sound that occurs at a second position within the vehicle body. The system further includes an active road-noise control module configured to provide a noise-reducing signal by processing the first sense signal and the second sense signal according to a first mode of operation or a second mode of operation. At least one loudspeaker is disposed at a third position within the vehicle body and is configured to generate noise-reducing sound at the second position from the noise-reducing signal. The system further includes a malfunction detection module configured to evaluate the operational state of the sensor arrangement and to control the active road-noise control module so that the active road-noise control module operates in the first mode of operation when the sensor arrangement is in a proper operational state and in the second mode of operation when a malfunction of the sensor arrangement has been detected.

An exemplary active road-noise control method includes using a sensor arrangement to generate a first sense signal representative of at least one acceleration, motion and/or vibration that occurs at a first position on a vehicle body and a second sense signal representative of sound that occurs at a second position within the vehicle body. The method also provides a noise-reducing signal by processing the first sense signal and the second sense signal according to a first mode of operation or a second mode of operation. The method further includes generating noise-reducing sound within the vehicle body at the second position from the noise-reducing signal and evaluating the operational state of the sensor arrangement; it also includes controlling processing of the first sense signal and the second sense signal so that the first sense signal and the second sense signal are processed in the first mode of operation when the sensor arrangement is in a proper operational state and in the second mode of operation when a malfunction of the sensor arrangement has been detected.

BRIEF DESCRIPTION OF THE DRAWINGS

The disclosure may be better understood by reading the following description of non-limiting embodiments attached to the drawings, in which like elements are referred to with like reference numbers, wherein below.

DETAILED DESCRIPTION

Noise and vibration sensors provide reference inputs to active RNC systems (e.g., multi-channel feed-forward active road-noise control systems) as a basis for generating the anti-noise that reduces or cancels road noise. Noise and vibration sensors may include acceleration sensors such as accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting the magnitude and direction of proper acceleration; they can be used to sense orientation, coordinate acceleration, motion, vibration and shock.

Airborne and structure-borne noise sources are monitored by the noise and vibration sensors in order to provide the highest possible road-noise reduction (cancellation) performance between 0 Hz and 1 kHz. For example, acceleration sensors used as input noise and vibration sensors may be disposed across the vehicle to monitor the structural behavior of the suspension and other axle components for global RNC. Above a frequency range that extends between 0 Hz and approximately 500 Hz, acoustic sensors that measure the airborne road noise may be used as reference control inputs. Furthermore, two microphones may be placed in the headrest in close proximity to the passenger's ears to provide an error signal or error signals in case of binaural reduction or cancellation. The feed-forward filters are tuned or adapted to achieve maximum noise reduction or noise cancellation at both ears.

Figure 1:
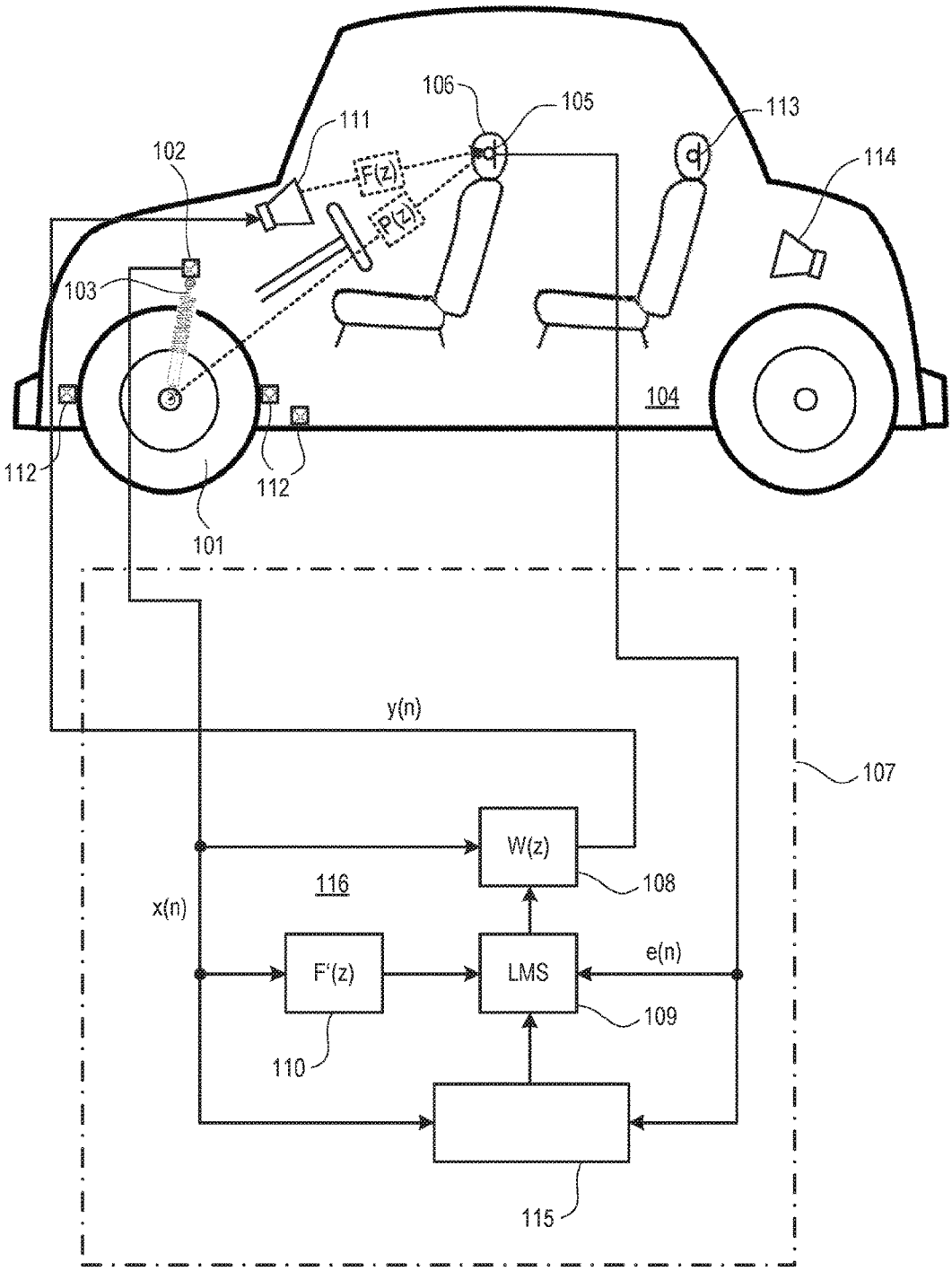
FIG. 1 is a schematic diagram illustrating an exemplary simple single-channel active road-noise control system.

A simple single-channel feed-forward active RNC system may be constructed. as shown in FIG. 1. Vibrations that originate from wheel a 101 moving on a road surface are detected by a suspension acceleration sensor 102, which is mechanically coupled with suspension device 103 in an automotive vehicle 104 and which outputs a noise and vibration signal x(n); this vibration signal represents the detected vibrations and thus correlates with the road noise audible within the cabin. At the same time, an error signal e(n), which represents sound (including noise) present in the cabin of vehicle 104, is detected by an acoustic sensor (e.g., a microphone 105) arranged within the cabin in a headrest 106 of a seat the driver's seat). The road noise originating from wheel 101 is mechanically transferred to microphone 105 according to a transfer characteristic P(z).

Transfer characteristic W(z) of a controllable filter 108 is controlled by an adaptive filter controller 109. Adaptive filter controller 109 may operate according to the known least mean square (LMS) algorithm based on error signal e(n) and road-noise signal x(n), which is filtered with a transfer characteristic F'(z) by a filter 110, wherein W(z)=−P(z)/F(z). F'(z)=F(z), wherein F(z) represents the transfer function between a loudspeaker 111 and microphone 105. A signal y(n), which has a waveform inverse in phase to that of the road noise audible within the cabin, is generated by an adaptive filter 116; this is formed by at least controllable filter 108 and filter controller 109, which is based on the thus identified transfer characteristic W(z) and noise and vibration signal x(n). From signal y(n), a waveform inverse in phase to that of the road noise audible within the cabin is then generated by loudspeaker 111, which may be arranged in the cabin, to thereby reduce the road noise within the cabin. The exemplary system described above may employ an adaptive filter 107 with a straightforward single-channel feed-forward filtered-x LMS control structure, but other control structures (e.g., multi-channel structures with a multiplicity of additional channels, a multiplicity of additional noise sensors 112, a multiplicity of additional microphones 113 and/or a multiplicity of additional loudspeakers 114) may be applied as well.

The system shown in FIG. 1 further includes a malfunction detection module 115, which evaluates the operational state of acceleration sensor 102 and microphone 105, which together form a simple sensor arrangement. In this example, malfunction detection module 115 evaluates the sense signals from acceleration sensor 102 and microphone 105 (e.g., noise and vibration signal x(n) and error signal e(t)), and it controls an active road-noise control module, which includes adaptive filter 116 so that adaptive filter 116 operates in a first mode of operation when the sensor arrangement is in a proper operational state and in a second mode of operation when a malfunction of the sensor arrangement has been detected. Additional acceleration sensors 112 and additional microphone 113 may optionally be connected to malfunction detection module 115 for further evaluation (connections not shown in FIG. 1).

Figure 2:
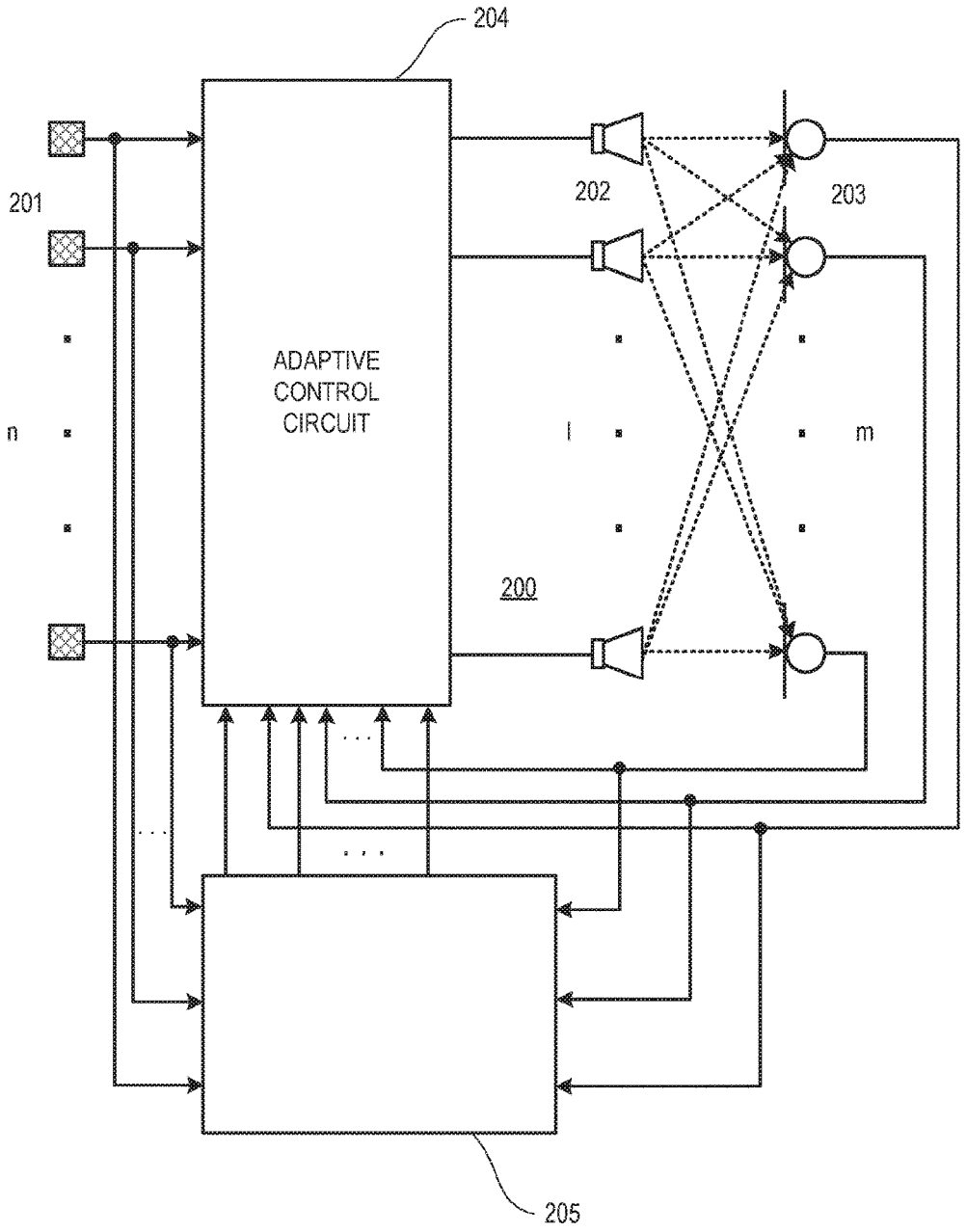
FIG. 2 is a schematic diagram illustrating an exemplary simple multi-channel active road-noise control system.

FIG. 2 shows an active road-noise control system 200, which is a multi-channel active road-noise control system capable of suppressing noise from a plurality of noise and vibration sources. Active road-noise control system 200 comprises a multiplicity n of noise and vibration sensors 201, a multiplicity l of loudspeakers 202, a multiplicity m of microphones 203 (acoustic sensors) and an adaptive control circuit 204, which operates to minimize the error between the noise and vibration sources (primary noise) and cancelling noise (secondary noise). Adaptive control circuit 204 may include a number of control circuits provided for each of the loudspeakers 202, which create cancelling signals to cancel noise from corresponding noise and vibration sources.

The system shown in FIG. 2 further includes a malfunction detection module 205, which evaluates the operational state of acceleration sensors 201 and microphones 203, which together form another sensor arrangement. In this example, malfunction detection module 205 evaluates the sense signals from acceleration sensors 201 and microphones 203, and it controls an active road-noise control module formed by adaptive control circuit 204 so that adaptive control circuit 204 operates in a first mode of operation when the sensor arrangement is in a proper operational state and in a second mode of operation when a malfunction of the sensor arrangement has been detected.

In conventional active RNC systems, the malfunction of only one sensor can significantly deteriorate the system performance or even give rise to unwanted audible artifacts. However, it is challenging not only to detect a malfunction with a sufficient degree of certainty, but also to decide, upon successful detection, how to proceed with this information, aside from switching off the whole system. The determination of whether the mode of operation has changed and in what way it has changed may depend on information such as how many sensors exhibit malfunctions, which and what types of sensors exhibit malfunctions, what types of malfunctions are detected and what their specific effects on the system Malfunction detection modules 115 and 205 evaluate the operational statuses of the sensors, use their evaluations to determine if one or more of the sensors exhibit malfunctions and, optionally, determine how severe these malfunctions are.

Figure 3:
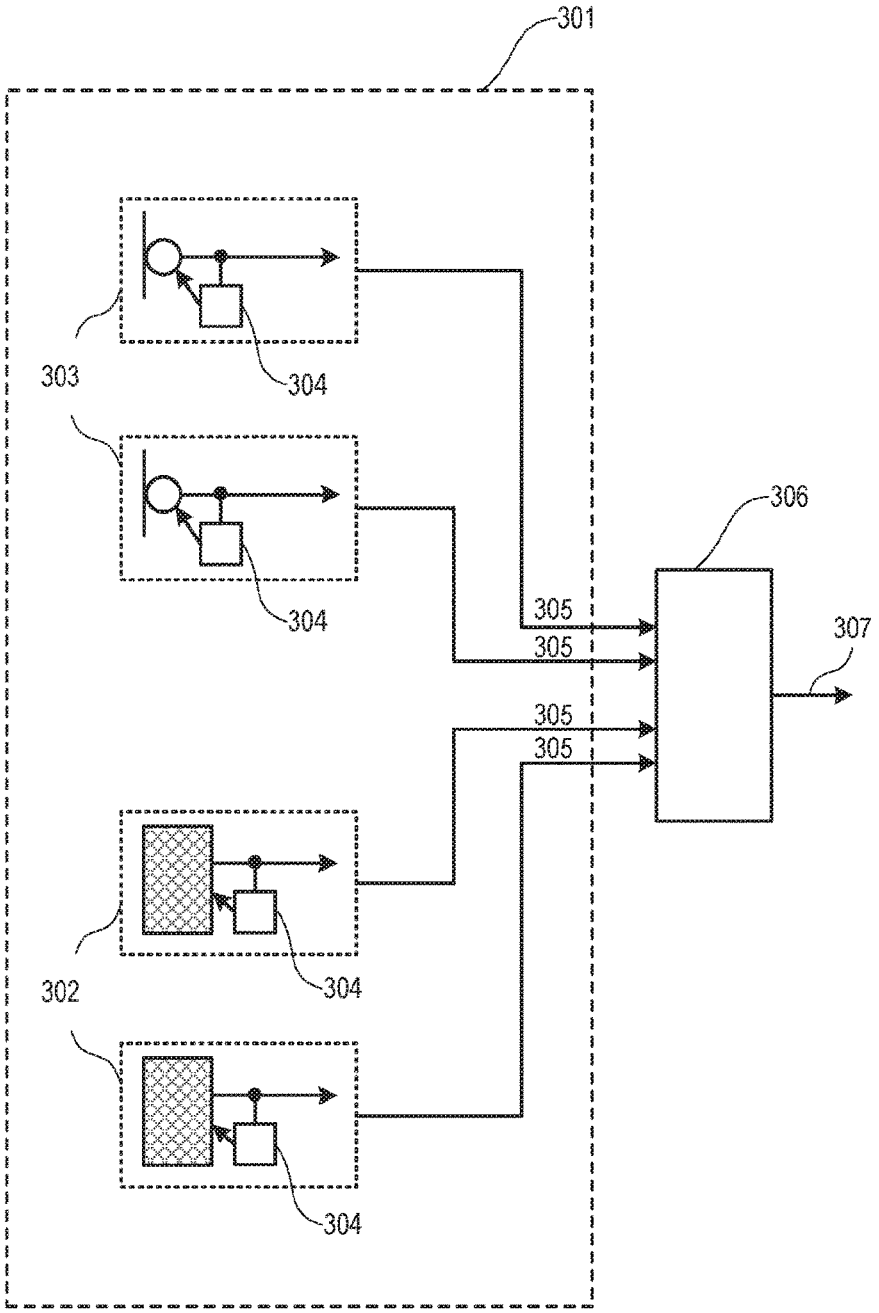
FIG. 3 is a schematic diagram illustrating a noise and vibration sensor arrangement with built-in self-test modules.

An exemplary way to determine a malfunction is shown in FIG. 3. Procedures and modules for detecting malfunctions are herein also referred to as "test procedures", "test modules", "diagnosis procedures" or "diagnosis modules". Sensor arrangement 301 includes a multiplicity of noise and vibration sensors 302 (e.g., provided by acceleration sensors 302) and acoustic sensors 303 (e.g., provided by microphones). Exemplary built-in self-test modules 304 may be integrated into both acceleration sensor 302 and acoustic sensor 303 to test the respective sensor. If built-in self-test module 304 detects a malfunction of sensor arrangement 301, it generates a signal 305, which indicates a malfunction of a malfunction detection module 306; this then outputs malfunction detection signal 307. Built-in self-test module 304 may include the generation of a defined mechanical or acoustic stimulus and the evaluation of the respective sensor's response to the stimulus. Additionally or alternatively, the built-in self-test module may include the generation of a defined electrical stimulus and the evaluation of the respective sensor's response to the stimulus.

An exemplary test module may be operable to test each sensor per se with built-in self-test modules 304 described above in connection with FIG. 3), but it may alternatively or additionally test groups of sensors or simply all sensors of an active road-noise system. Groups of sensors may be formed according to different criteria such as groups of only acoustic sensors, groups of only noise and vibration sensors, groups of adjacent sensors, groups of pairs of an acoustic sensors and noise and vibration sensors, etc.

Figure 4:
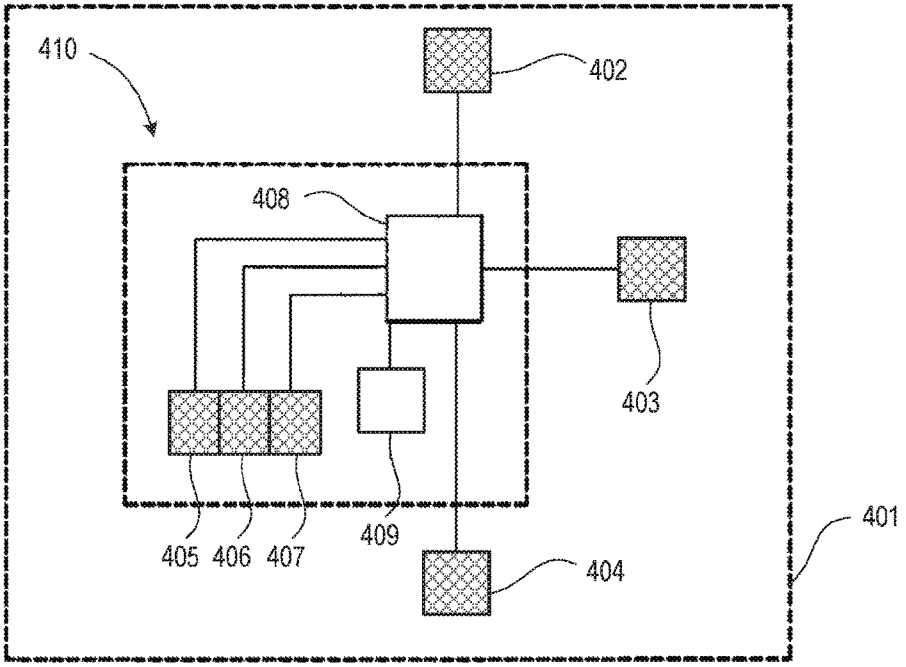
FIG. 4 is a schematic diagram illustrating a noise and vibration sensor arrangement with a central test module.

FIG. 4 illustrates selected portions of another exemplary sensor arrangement 401. In this example, sensor arrangement 401 has six acceleration sensors 402-407 distributed all over a vehicle (not shown), as well as a central test module 405 disposed somewhere in the vehicle. Central test module 410, which may be a portion of a malfunction detection module (not shown), may include a microprocessor 408, a non-volatile memory 409 and three (405-407) of the six acceleration sensors 402-407. Microprocessor 408 is in electrical communication with acceleration sensors 402-407 and the non-volatile memory 409 to store information received from acceleration sensors 402-407 along with other information.

Acceleration sensors 402-407 generate sense signals in response to physical stimuli such as vehicle movement. Microprocessor 408 receives the sense signals representative of the accelerations that act on acceleration sensors 402-407 and that represent the noise and vibrations. Microprocessor 408 processes these inputs (e.g., in an algorithm) to decide whether each sense signal generated by acceleration sensors 402-407 can be considered valid or invalid. The algorithm may include a plausibility check of the sense signals. The plausibility may depend upon expected physical stimuli acting on acceleration sensors 402-407 or on any other appropriate sensors in the vehicle. For example, a mechanical impulse of a certain strength (e.g., mechanical impact on the tires when driving on a bumpy road) sensed by a multiplicity of sensors can be considered sufficient to stimulate all sensors. If one or more sensors do not respond to such stimuli, it appears as though this sensor or these sensors have malfunctioned.

In yet another exemplary sensor, the sensor sensitivity may be used as a fault indicator. Above a certain vehicle speed (e.g., 80 km/h), the road vibrations are sufficient to generate 1 g of vibration on the chassis so that an evaluation module can compare the output of the sensor to a stored sensitivity value of the sensor, which represents the output of a sensor at the certain speed.

Another way to detect malfunctioning sensors includes calculating a damped integration of each sense signal. The damped integration entails integrating the respective sense signal to produce an integrated value and subtracting an offset value at each iteration step to produce a damped value. The offset value is preset to correspond to expected normal driving conditions(e.g., from collected driving data over a variety of terrains, driving conditions and specified sensor tolerances). Microprocessor 408 may compare the damped integration to a fixed threshold value. If the damped integration exceeds the threshold value, microprocessor 408 concludes that the respective sensor has malfunctioned.

As the sensors employed are acceleration sensors 402-407 (e.g., accelerometers), the integration of their acceleration signal results in velocity. Integrating the acceleration with a small offset produces a damped velocity. If the vehicle's damped velocity change is too large (i.e., exceeds a threshold), microprocessor 408 concludes that the sensor under investigation has malfunctioned. In other words, if the sensor measures accelerations beyond the normal expected physical limitations of the vehicle, the sensor has malfunctioned. For example, assume an offset value for an accelerometer is 2 g and the failure threshold for the damped velocity is set to 100 mph. There are only two ways the vehicle's accelerometer can achieve a damped velocity of 100 mph. One way involves a severe crash and the other involves a malfunctioning sensor.

If microprocessor 408 determines that any one of sensors 402-407 has malfunctioned, microprocessor 408 may set a failure code in non-volatile memory 409, and it may prevent the sensor's signal from being used by a subsequent active road-noise control algorithm.

In another example, the damped integration algorithm is modified in that the vehicle speed is used to determine the method of integration. Information represent a of the vehicle speed may be supplied to microprocessor 408, and this information may be used to determine whether the vehicle is moving. If the vehicle's speed information indicates to microprocessor 408 that the vehicle is not moving, microprocessor 408 uses a different integration method by using the absolute value of the sense signals. Since the vehicle is not moving, there is no oscillation of the sense signals between positive and negative values. By using the absolute value, the calculated damped integration can grow toward the threshold value regardless of the sign of the sense signal. This provides for the quick detection of malfunctioning sensors that oscillate around a zero point.

An alternative way to detect malfunctioning sensors includes monitoring the sense signals relative to threshold zones and relative to all other sensors in the system. In one example, a sensor's fail counter is increased when its sense signal is outside of its corresponding threshold zone. The threshold zone for each sensor may be preset, depending upon expected driving conditions and specified sensor tolerances. If the sense signal re-enters the threshold zone, the sensor's fail counter is decreased. The sensor's fail counter is reset when one of the other sense signals leaves its respective threshold zone. Thus, when the counter of a sensor exceeds its predetermined counter threshold, the other sensors remain inside their respective threshold zones. Once the sensor's fail counter exceeds a predetermined counter threshold, microprocessor 408 identities this sensor as malfunctioning.

Figure 5:
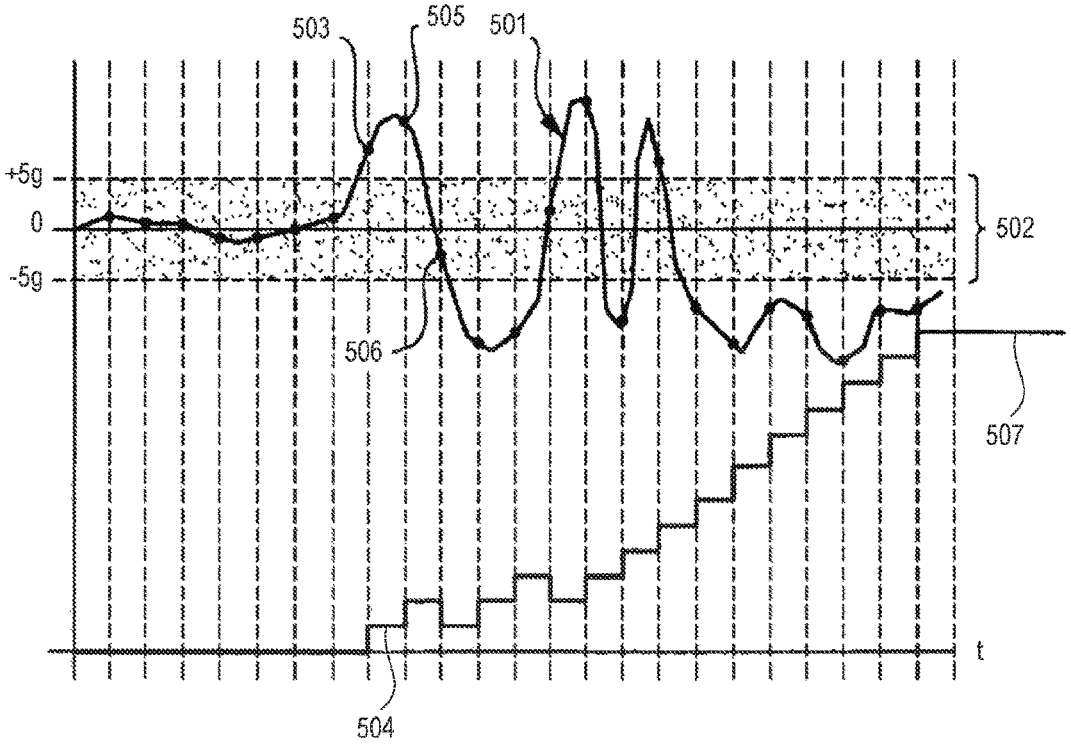
FIG. 5 is a graph illustrating one exemplary process of increasing or decreasing a counter value in response to an acceleration sense signal.

FIG. 5 is an acceleration vs. time diagram that illustrates one exemplary operation of a sensor diagnostic method for an acceleration sensor. In this example, a sense signal 301 is represented in physical units of acceleration (i.e., 1 g=9.81 $m/s^2$). A threshold zone 502 extends between 5 g and −5 g. It is to be understood that the size of threshold zone 502 can vary based on the type of sensor, the sensitivity of the sensor and the expected driving conditions of the vehicle. Sense signal 501 may initially be within threshold zone 502. The sense signal leaves (exceeds) threshold zone 502 at a point 503, causing the counter to increase its count by one increment (shown by line 504). At point 505, sense signal 501 remains outside of threshold zone 502, and the count increases by another increment. At point 506, sense signal 501 returns to threshold zone 502, and the count decreases by an increment. In the illustrated example, the sense signal continues to oscillate into and out of threshold zone 502 until the count reaches a predetermined threshold 507. In response to reaching predetermined threshold 507, microprocessor 408 identifies the sensor under investigation as malfunctioning. In the above example, the count increases or decreases by one increment, depending on whether the sense signal is inside or outside threshold zone 502. Alternatively, the count may be increased or decreased by more than one increment.

Figure 6:
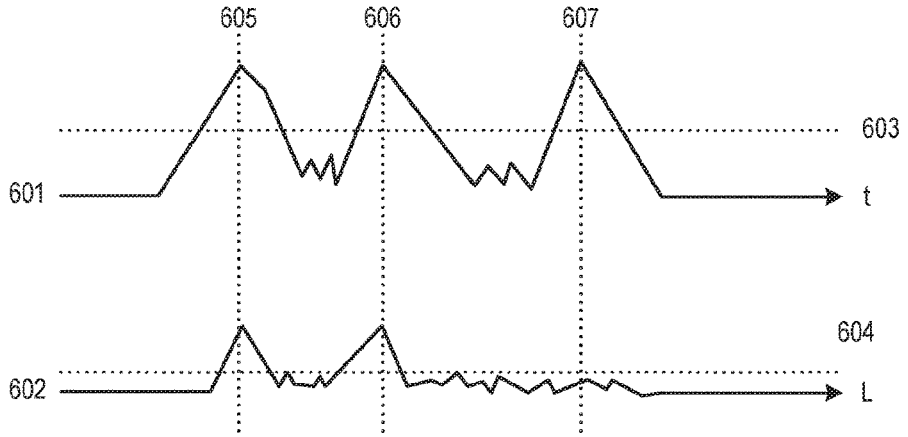
FIG. 6 is a graph illustrating partly correlating sense signals.

In yet another (additional or alternative) diagnostic method, a malfunction detection module may compare the sense signal or signals from at least one noise and vibration sensor with the sense signal or signals from at least one microphone to evaluate the operational state of the sensors. Besides simply comparing amplitudes, the time structures of sense signals may also be compared. As can be seen in FIG. 6, the time structure of a noise and vibration signal 601 from an acceleration sensor correlates to an acoustic sense signal 602 from a microphone above certain signal levels 603 and 604. For example, high-amplitude pulse-shaped stimuli 605-607 may similarly appear in both sense signals 601 and 602. If there is no correlation for certain high-amplitude pulse-shaped stimuli, such as stimulus 607, the microprocessor will determine (possibly in connection with other diagnostic results) that a sensor (e.g., the acoustic sensor) has malfunctioned. A similar approach may he made when comparing noise and vibration sense signals with each other and/or comparing the acoustic sense signals with each other to evaluate the operational state of the sensor arrangement (i.e., signals 601 and 602 may be only noise and vibration sense signals or only acoustic signals).

Figure 7:
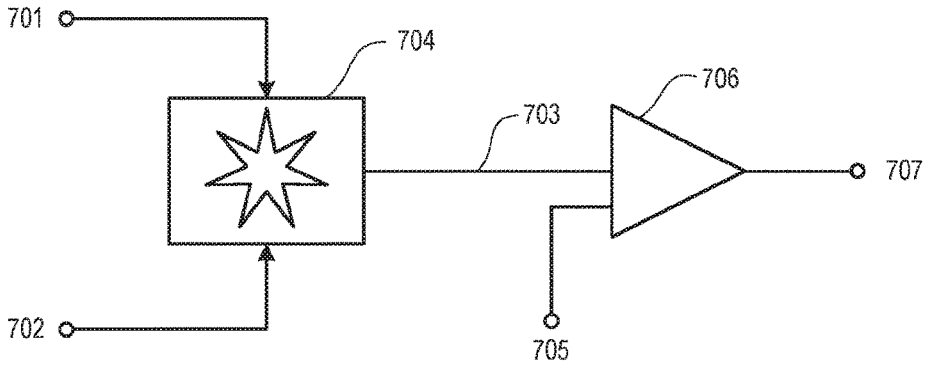
FIG. 7 is a block diagram illustrating a correlation detection module.

Referring to FIG. 7, which illustrates a correlation detection module, the correlation of the time structures of the two sense signals 701 and 702 under investigation may be determined by calculating or estimating a correlation value a cross-correlation value 703), which represents a correlation between the two sense signals 701 and 702 by way of a cross-correlation calculation module 704. Correlation value 703 may be compared to a threshold value 705 in a comparator module 706 to issue a decision 707 on whether the signals are considered to have similar or different time structures.

Figure 8:
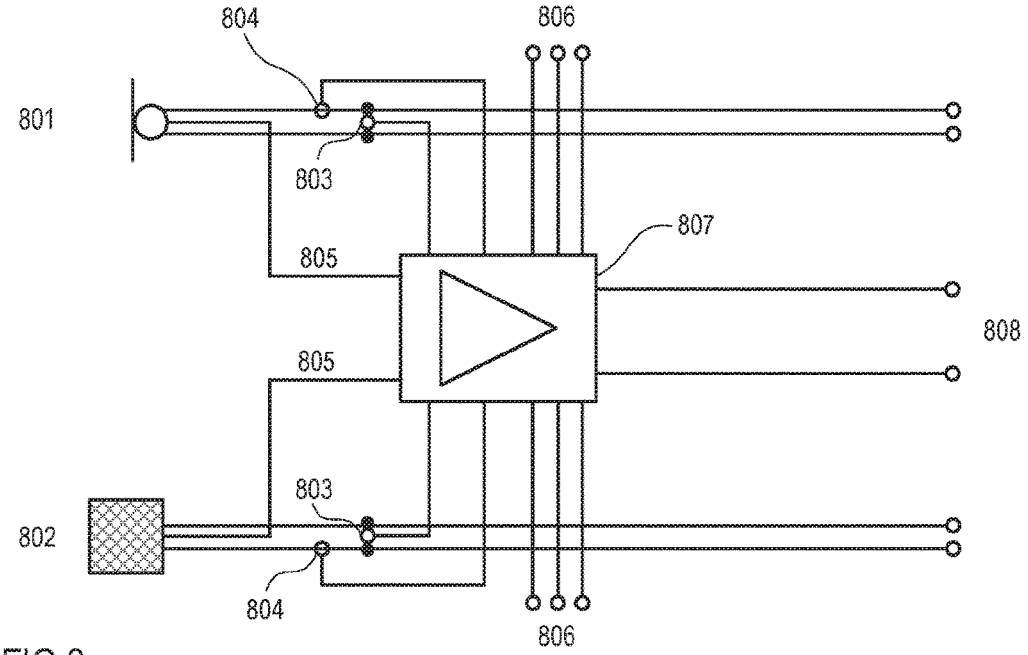
FIG. 8 is a block diagram illustrating a module for evaluating the voltages supplied to and the currents flowing through the sensors under investigation and for evaluating the sense signals.
Figure 9:
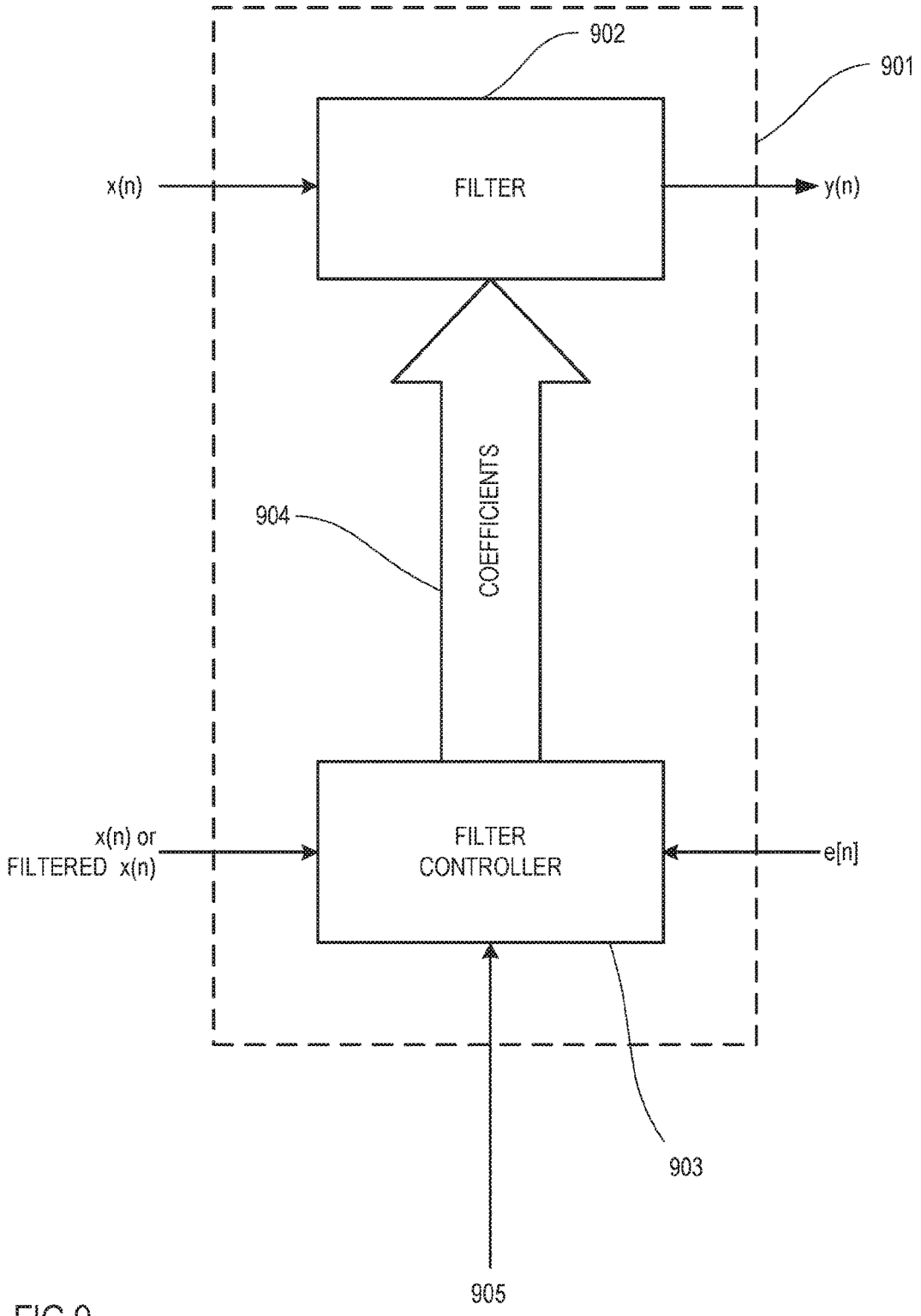
FIG. 9 is a block diagram illustrating an adaptive filter that has at least two different modes of operation.

Referring to FIG. 8, a very simple but effective (additional or alternative) diagnostic method is to evaluate voltages 803 supplied to and/or currents 804 flowing through the sensors 801 and 802 under investigation and/or to evaluate sense signals 805 output by sensors 801 and 802 (e.g., by comparing these signals with certain thresholds 806 in a comparator module 807 to issue signals 808, which identify malfunctioning sensors).

When at least one malfunctioning sensor is detected, the active road-noise control module (e.g., an active road-noise control modules 115 and 205 shown in FIGS. 1 and 2) is controlled to change from a first mode of operation (e.g., a normal mode of operation) to a second mode of operation, which may be a single predefined exceptional mode or a specific mode selected from a multiplicity of exceptional modes based on the detected malfunction. For example, in normal mode, active road-noise control module 115, described above in connection with FIG. 1, may be operated in a combined feed-forward and feedback structure and, if a malfunction of acceleration sensor 102 is detected, active road-noise control module 115 is switched to a feedback structure, which may be a simple configuration of a fixed or adaptive noise cancellation filter 116 connected between microphone 105 and loudspeaker 111. If a malfunction of microphone 105 is detected, adaptive filter 107 may be connected to microphone 113, possibly with some additional filtering.

In another example, an adaptive filter 901, which may replace adaptive filter 116 in the single-channel active road-noise control system shown in FIG. 1, includes a controllable filter 902 and a filter controller 903. A first mode of operation and a second mode of operation of adaptive filter 901 may differ in basic filter coefficients 904 of controllable filter 902 and/or the way filter coefficients 904 are controlled or adapted by filter controller 903 and thus between differ (variable) transfer functions of adaptive filter 901. For example, adaptive filter 901, whose mode of operation may be changed by a control signal 905, is optimized for n sensors in its normal mode of operation and has a first transfer function upon adaptation. Assuming m sensors exhibit malfunctions and are disconnected, adaptive filter 901 is then controlled to have a second transfer function optimized for n-m sensors. Alternatively, the malfunctioning sensors in some systems may be switched off, and adaptive filter 901 may be reset to the basic coefficients so that adaptation starts again and is performed based on the changed conditions. In another alternative, controllable filter 902 may be set to a default (fixed) transfer function, and the adaptation process may be stopped.

Figure 10:
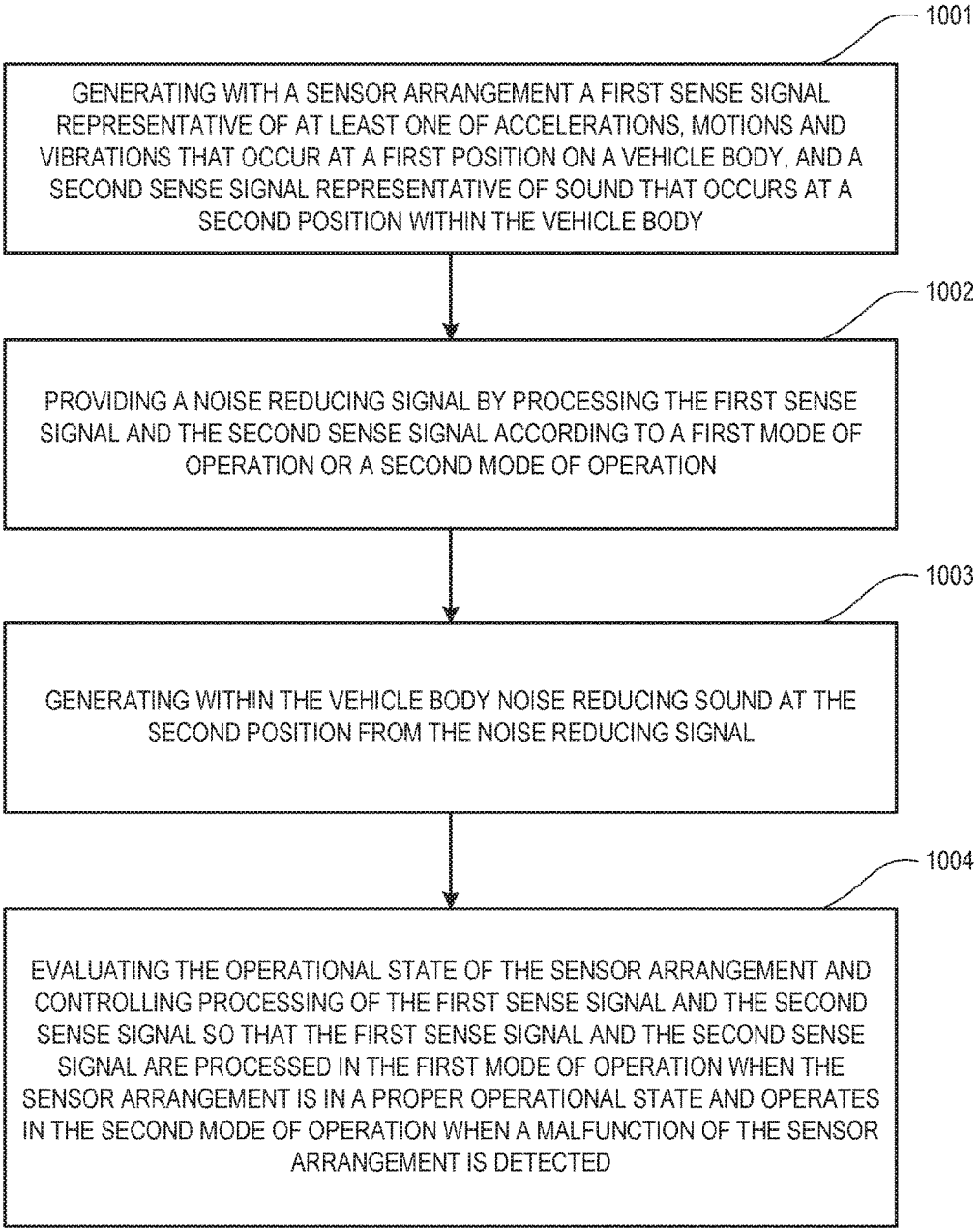
FIG. 10 is a flow chart of an exemplary active road-noise control method.

Referring to FIG. 10, an exemplary method such as the one implemented in the systems described above in connection with FIGS. 1 and 2 may include using a sensor arrangement to generate a first sense signal representative of at least one acceleration, motion and/or vibration that occurs at a first position on a vehicle body and a second sense signal representative of sound that occurs at a second position within the vehicle body (procedure 1001). The method further includes provides a noise-reducing signal by processing the first sense signal and the second sense signal according to a first mode of operation or a second mode of operation (procedure 1002), and it generates noise-reducing sound at the second position from the noise-reducing signal within the vehicle body (procedure 1003).

In a procedure 1004, provisions are made for evaluating the operational state of the sensor arrangement and controlling the processing of the first sense signal and the second sense signal so that the first sense signal and the second sense signal are processed in the first mode of operation when the sensor arrangement is in a proper operational state and in the second mode of operation when a malfunction of the sensor arrangement has been detected.

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described methods and associated actions may also be performed simultaneously, in parallel and/or in orders varied from the order described in this application. The described systems are exemplary in nature; they may include additional elements and/or omit elements.

As used in this application, an element or step denoted in the singular and preceded with the word a or an should be understood as not excluding the plural of said elements or steps, unless such exclusion is stated. Furthermore, references to "one embodiment" and "one example" of the present disclosure are not intended to be interpreted to exclude the existence of additional embodiments that also incorporate the described features. The terms first, second, third, etc. are used merely as labels, and are not intended to impose numerical requirements or a particular positional order on their objects.

The invention claimed is:

1. An active road-noise control system comprising:

a sensor arrangement configured to generate a first sense signal representative of at least one of acceleration, motion and vibration that occurs at a first position on a vehicle body and a second sense signal representative of sound that occurs at a second position within the vehicle body;

an active road-noise control module configured to provide a noise-reducing signal by processing the first sense signal and the second sense signal according to a first mode of operation or a second mode of operation;

at least one loudspeaker disposed at a third position within the vehicle body and configured to generate noise-reducing sound at the second position from the noise-reducing signal; and a malfunction detection module configured to evaluate an operational state of the sensor arrangement and to control the active road-noise control module to operate in the first mode of operation when the sensor arrangement is in a proper operational state and to operate in the second mode of operation when a malfunction of the sensor arrangement has been detected, wherein the malfunction detection module is further configured to compare the first sense signal to the second sense signal to evaluate the operational state of the sensor arrangement.

2. The system of claim 1, wherein the sensor arrangement is configured to perform a built-in self-test to provide a signal that indicates the malfunction to the malfunction detection module if the built-in self-test detects a malfunction of the sensor arrangement.

3. The system of claim 1, wherein:

the sensor arrangement comprises at least one noise and vibration sensor and at least one acoustic sensor; and the malfunction detection module is further configured to evaluate at least one of:

voltages supplied to one or more of the at least one noise and vibration sensor and to the at least one acoustic sensor;

currents flowing through the one or more of the at least one noise and vibration sensor and the at least one acoustic sensor; and sense signals generated by the one or more of the at least one noise and vibration sensor and the at least one acoustic sensor.

4. The system of claim 1, wherein:

the sensor arrangement comprises a multiplicity of noise and vibration sensors and a multiplicity of acoustic sensors, the multiplicity of noise and vibration sensors providing a multiplicity of first sense signals, and the multiplicity of acoustic sensors providing a multiplicity of second sense signals; and the malfunction detection module is further configured to at least one of compare each of the multiplicity of first sense signals with each other and compare the each of the multiplicity of second sense signals with each other to evaluate the operational state of the sensor arrangement.

5. The system of claim 4, wherein:

the malfunction detection module is further configured to calculate or estimate at least one of:

a first correlation value that represents a first correlation between the first sense signal and the second sense signal;

a second correlation value that represents a second correlation between the multiplicity of first sense signals and the multiplicity of second sense signals;

a third correlation value that represents a third correlation between the multiplicity of first sense signals; and a fourth correlation value that represents a fourth correlation between the multiplicity of second sense signals; and the malfunction detection module is further configured to compare at least one of the first correlation value, second correlation value, third correlation value and fourth correlation value with a respective threshold value to evaluate the operational state of the sensor arrangement.

6. The system of claim 1, wherein the second mode of operation includes a reset of the active road-noise control module.

7. The system of claim 1, wherein:

the active road-noise control module comprises an adaptive filter with a variable transfer function; and the second mode of operation includes at least one of setting the transfer function of the adaptive filter to a default transfer function and stopping the adaptation process.

8. An active road-noise control method comprising:

generating with a sensor arrangement a first sense signal representative of at least one of acceleration, motion and vibration that occurs at a first position on a vehicle body and a second sense signal representative of sound that occurs at a second position within the vehicle body;

providing a noise-reducing signal by processing the first sense signal and the second sense signal according to a first mode of operation or a second mode of operation;

generating noise-reducing sound within the vehicle body at the second position from the noise-reducing signal;

evaluating an operational state of the sensor arrangement;

controlling the processing of the first sense signal and the second sense signal in the first mode of operation when the sensor arrangement is in a proper operational state;

controlling the processing of the first sense signal and the second sense signal in the second mode of operation when a malfunction of the sensor arrangement has been detected; and comparing the first sense signal with the second sense signal to evaluate the operational state of the sensor arrangement.

9. The method of claim 8 further comprising performing a built-in self-test with the sensor arrangement to provide a signal that indicates the malfunction to a malfunction detection module if the built-in self-test detects a malfunction of the sensor arrangement.

10. The method of claim 8, further comprising evaluating at least one of:

voltages supplied to one or more of at least one noise and vibration sensor and at least one acoustic sensor;

currents flowing through the one or more of the at least one noise and vibration sensor and the at least one acoustic sensor; and sense signals generated by the one or more of the at least one noise and vibration sensor and the at least one acoustic sensor.

11. The method of claim 8, further comprising at least one of the following in order to evaluate the operational state of the sensor arrangement:

comparing a multiplicity of first sense signals with a multiplicity of second sense signals;

comparing a multiplicity of first sense signals with each other; and comparing a multiplicity of second sense signals with each other.

12. The method of claim 11, further comprising calculating or estimating at least one of the following:

a first correlation value representing a first correlation between the first sense signal and the second sense signal;

a second correlation value representing a second correlation between the multiplicity of first sense signals and the multiplicity of second sense signals;

a third correlation value representing a third correlation between the multiplicity of first sense signals;

a fourth correlation value representing a fourth correlation between the multiplicity of second sense signals; and comparing at least one of first correlation value, the second correlation value, the third correlation value and the fourth correlation value with a respective threshold value to evaluate the operational state of the sensor arrangement.

13. The method of claim 8, wherein the second mode of operation includes a reset in the processing of the first sense signal and the second sense signal.

14. The method of claim 8, wherein:

processing of the first sense signal and the second sense signal comprises adaptive filtering with a variable transfer function; and the second mode of operation includes setting the variable transfer function to a default transfer function and/or stopping the adaptation process.

15. An active road-noise control system comprising:

a sensor arrangement configured to generate a first sense signal representative of at least one of acceleration, motion and vibration that occurs on a vehicle body and a second sense signal representative of sound that occurs within the vehicle body;

an active road-noise control module configured to process the first sense signal and the second sense signal according to a first mode of operation or a second mode of operation to provide a noise-reducing signal;

at least one loudspeaker disposed within the vehicle body and configured to generate noise-reducing sound from the noise-reducing signal; and a malfunction detection module configured to evaluate an operational state of the sensor arrangement and to control the active road-noise control module to operate in the first mode of operation when the sensor arrangement is in a proper operational state and to operate in the second mode of operation when a malfunction of the sensor arrangement has been detected, wherein the malfunction detection module is further configured to compare the first sense signal to the second sense signal to evaluate the operational state of the sensor arrangement.

16. The system of claim 15, wherein the sensor arrangement is configured to perform a built-in self-test to provide a signal that indicates the malfunction to the malfunction detection module if the built-in self-test detects a malfunction of the sensor arrangement.

17. The system of claim 15, wherein:

the sensor arrangement comprises at least one noise and vibration sensor and at least one acoustic sensor; and the malfunction detection module is further configured to evaluate at least one of:

voltages supplied to one or more of the at least one noise and vibration sensor and to the at least one acoustic sensor;

currents flowing through the one or more of the at least one noise and vibration sensor and the at least one acoustic sensor; and sense signals generated by the one or more of the at least one noise and vibration sensor and the at least one acoustic sensor.

18. The system of claim 15, wherein:

the sensor arrangement comprises a multiplicity of noise and vibration sensors and a multiplicity of acoustic sensors, the multiplicity of noise and vibration sensors providing a multiplicity of first sense signals, and the multiplicity of acoustic sensors providing a multiplicity of second sense signals; and the malfunction detection module is further configured to at least one of compare each of the multiplicity of first sense signals with each other and compare the each of the multiplicity of second sense signals with each other to evaluate the operational state of the sensor arrangement.

* * * * *